US005465450A

United States Patent [19]

Humphries

[11] Patent Number: 5,465,450

[45] Date of Patent: Nov. 14, 1995

[54] TOOTHBRUSH

[76] Inventor: Victor A. Humphries, 83 River Road, Emu Plains, NSW 2750, Australia

[21] Appl. No.: 131,877

[22] Filed: Oct. 5, 1993

Related U.S. Application Data

[63] Continuation of Ser. No. 829,076, filed as PCT/AU91/00257, Jun. 17, 1991, published as WO91/19438, Dec. 26, 1991, abandoned.

[30] Foreign Application Priority Data

Jun. 15, 1990 [AU] Australia ..... PK0665

[51] Int. Cl.[6] ..... A46B 9/04

[52] U.S. Cl. ..... 15/167.1; 15/144.1; 15/172; 15/201

[58] Field of Search ..... 15/167.1, 167.2, 15/172, 201

[56] References Cited

U.S. PATENT DOCUMENTS

| | | | |
|---|---|---|---|
| 1,494,448 | 5/1924 | Sookne | 15/167.1 |
| 1,894,509 | 1/1933 | Booth | 15/201 |
| 2,254,365 | 9/1941 | Griffith | 15/167.1 |
| 2,685,703 | 8/1954 | Dellenbach | 15/167.1 |
| 3,188,672 | 6/1965 | Gary | 15/167.1 |
| 3,868,742 | 3/1975 | Brenner . | |
| 4,472,853 | 9/1984 | Rauch | 15/167.1 |
| 4,654,922 | 4/1987 | Chen | 15/201 |
| 4,691,405 | 9/1987 | Reed . | |
| 4,712,266 | 12/1987 | Yamaki | 15/172 |
| 4,757,570 | 7/1988 | Haeusser | 15/167.2 |
| 4,829,621 | 5/1989 | Phenegar . | |
| 5,001,803 | 3/1991 | Discko, Jr. | 15/167.1 |

FOREIGN PATENT DOCUMENTS

| | | | |
|---|---|---|---|
| 59009/86 | 12/1987 | Australia . | |
| 582098 | 4/1988 | Australia . | |
| 44932/89 | 5/1990 | Australia . | |
| 75961/91 | 11/1991 | Australia . | |
| 0508049 | 12/1954 | Canada | 15/167.1 |
| 393882 | 4/1924 | Germany . | |
| 660830 | 6/1938 | Germany . | |
| 460705 | 10/1968 | Switzerland . | |
| 0019408 | of 1897 | United Kingdom | 15/167.1 |
| 0680455 | 10/1952 | United Kingdom | 15/167.1 |

*Primary Examiner*—David Scherbel
*Assistant Examiner*—Randall E. Chin
*Attorney, Agent, or Firm*—Kenyon & Kenyon

[57] ABSTRACT

A toothbrush having an elongated handle part and a head part with bristles projecting there from. A neck part joins the handle part. The head part has at least one region thereof weakened so as to allow deformation in the head part to suit the shape of the user's dental arches.

12 Claims, 2 Drawing Sheets

TOOTHBRUSH

This application is a continuation of application Ser. No. 07/829,076, filed as PCT/AU91/00257, Jun. 17, 1991, now abandoned.

FIELD OF INVENTION

The present invention relates to toothbrushes and in particular to a toothbrush that may be deformed to suit the shape of the user's dental arches or for other purposes.

BACKGROUND ART

Deformable toothbrushes which are designed to bend or pivot in the neck part between the head and handle are known. For instance, Australian Patent No. 582,098 discloses a toothbrush incorporating a deformable plastic neck. The manner in which the neck deforms is continuous and gradual and the toothbrush is not adapted to be deformed in the head part. Toothbrushes that can discretely pivot in the neck part are disclosed in U.S. Pat. No. 3,868,742. However, the pivoting of the head part about the neck part is in a plane parallel to the upper surface of the handle.

Neither of these types of toothbrush have means whereby the head part of the toothbrush may be deformed. It is, therefore, an object of the present invention to provide a toothbrush in which the head part is deformable, either with or without the adjacent neck part being deformable, so that the shape of the toothbrush may be adjusted to suit the particular size and shape of the user's dental arches.

DISCLOSURE OF THE INVENTION

According to the invention, there is provided a toothbrush comprising an elongated handle part, a head part, and a neck part joining the handle part and the head part, said head part having bristles projecting from at least one side thereof and having at least one region thereof weakened so as to allow deformation in the head part to suit the shape of the user's dental arches.

In a preferred form of the invention, the neck part is of smaller cross sectional area than the adjacent parts of the head part and handle part.

Preferably, the neck part includes at least one region thereof weakened so as to allow deformation in the neck part to suit the shape of the user's dental arches.

Preferably, the region at which the deformation occurs comprises a localised narrowing in the cross section of the head or neck part. Pressure applied adjacent to the or each narrowed region results in a sharp and discrete deformation. Other means by which the structure may be weakened are contemplated by the invention, such as by provision at the weakened region of material that is less dense than the surrounding material.

BRIEF DESCRIPTION OF THE DRAWINGS

In order that the invention may be more readily understood and put into practical effect, reference will now be made to the accompanying drawings in which.

DESCRIPTION OF PREFERRED EMBODIMENT

Figure 1:
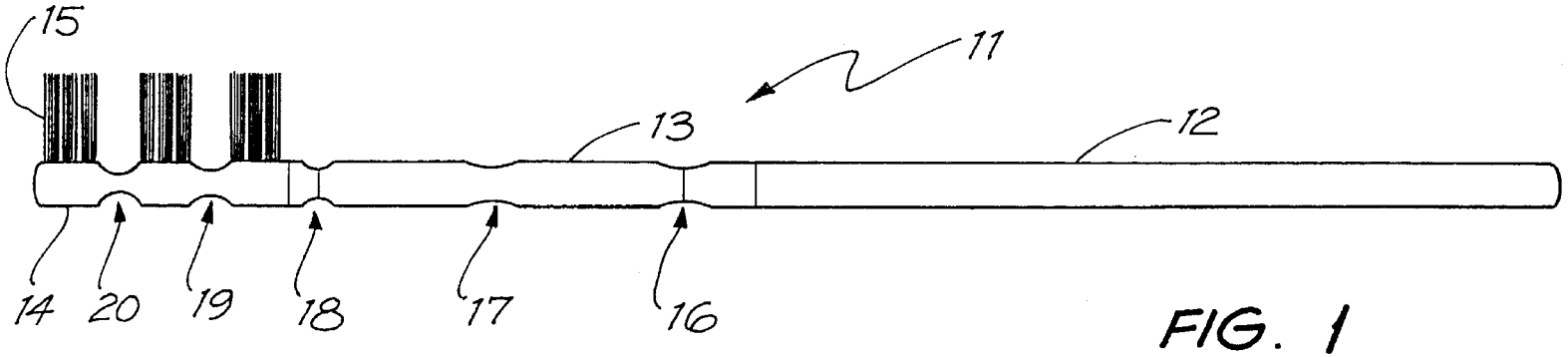
FIG. 1 is a side view of a toothbrush according to one embodiment of the invention.
Figure 2:
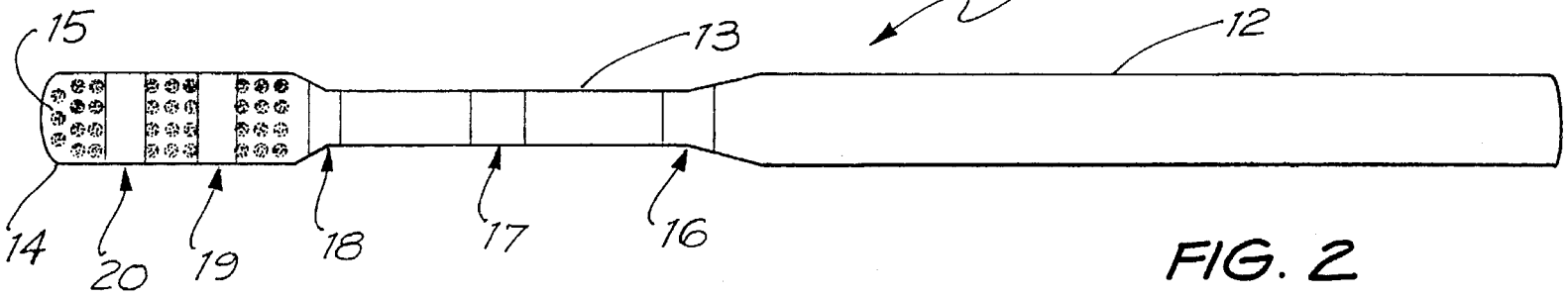
FIG. 2 is a top view of the toothbrush of FIG. 1.

The toothbrush 11 shown in FIGS. 1 and 2 comprises a handle 12, a neck 13 and a head 14 having an array of bristles 15 attached thereto in any convenient way. The neck 13 has been weakened at regions or loci 16, 17 and 18 through a narrowing of the cross section of the neck at those sites. The head 14 has been weakened at regions 19 and 20 by narrowing the cross section of the head 14 at those regions. Rows of bristles are missing from each of the regions 19 and 20.

Figure 3:
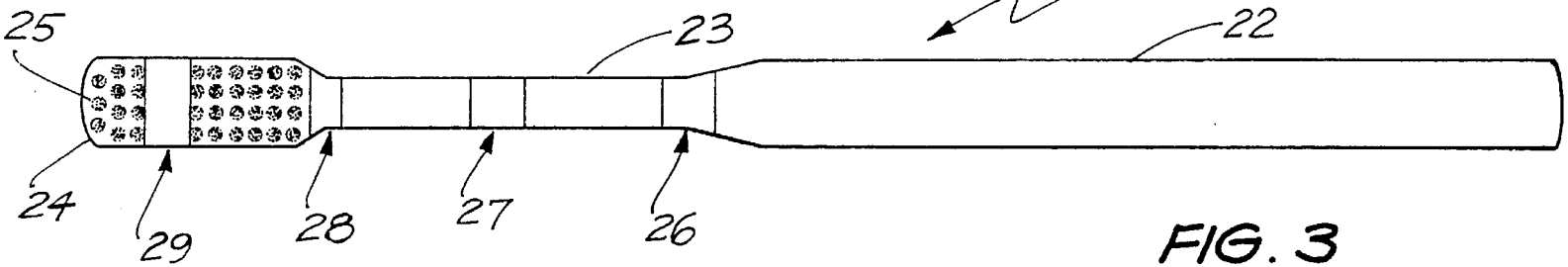
FIG. 3 is a top view of a toothbrush according to a second embodiment of the invention.

The toothbrush 21 show in FIG. 3 also comprises a handle 22, neck 23 and head 24 with an array of bristles 25 attached thereto in any convenient way. The neck 23 is narrowed at regions 26, 27 and 28 whilst the head 24 is narrowed at region 29. Rows of bristles are missing from region 29.

The weakness in structure arising from the narrowing of these regions in the neck and head of both toothbrushes of FIGS. 1 and 3 allow these toothbrushes to be deformed at these sites. This deformation can be sharp and discrete at those sites.

The invention is not restricted to the weakening in the head part (and optionally the neck part) being a discrete narrowing in particular regions of these parts, and any manner of weakening is contemplated by the invention so long as it allows one or more deformations in the appropriate part to suit the shape of the user's dental arches, and whether or not it leads to a sharp and discrete deformation at the weakened regions. In some circumstances, it may be useful for only the head part or the neck part to have a weakened region.

The material from which the toothbrushes of FIGS. 1 to 6 may be integrally constructed are those commonly used in the manufacture of toothbrushes and which can withstand the pressure needed to deform the toothbrush to its required shape and to maintain that shape during use. Preferably, the material is a transparent or translucent hydrocarbon resin which can be readily manipulated and deformed at its weakened regions at room temperature or under hot water. The material used may also be an opaque styrene polymer or copolymer which can be manipulated at higher temperatures. Preferably, a plastic material commonly referred to as PETG is used.

Figure 4:
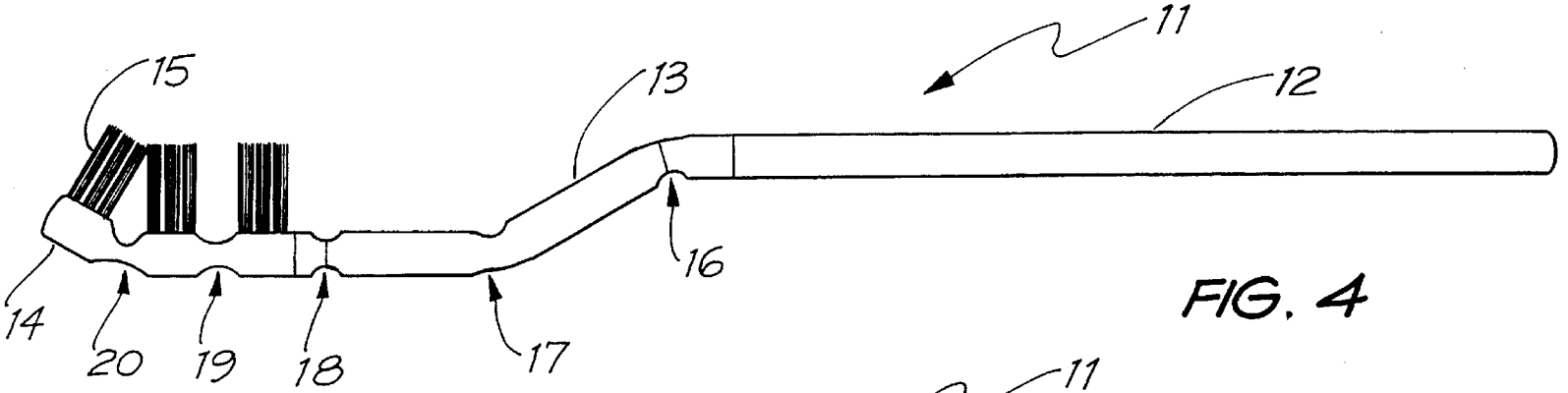
FIG. 4 is a side view of the toothbrush of FIG. 1 that has been deformed to suit the shape of the dental arches of a particular first user.
Figure 5:
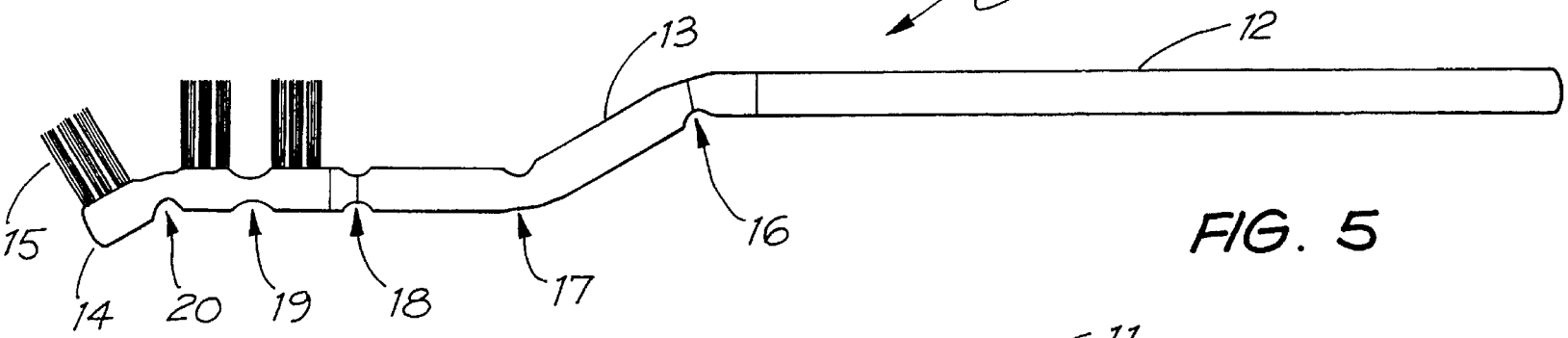
FIG. 5 is a side view of the toothbrush of FIG. 1 that has been deformed to suit the shape of the dental arches of a particular second user.
Figure 6:
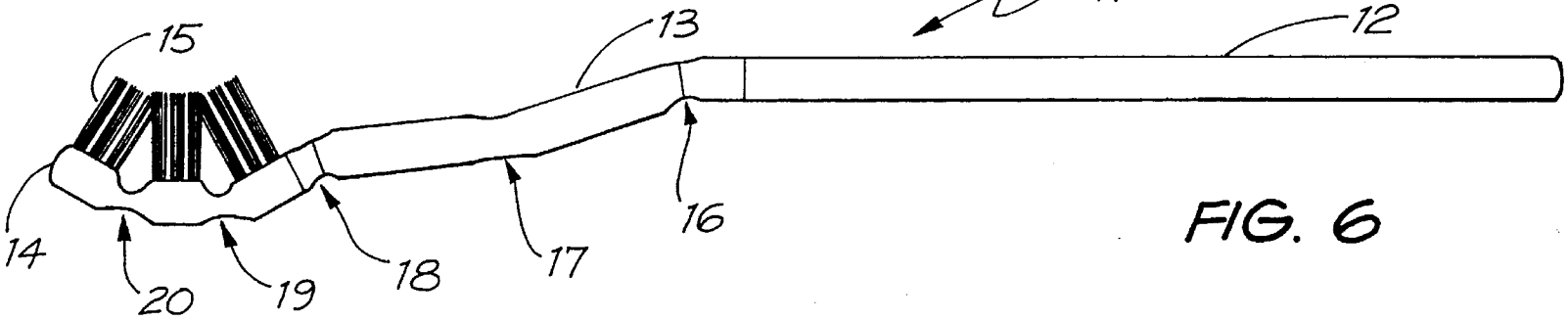
FIG. 6 is a side view of the toothbrush of FIG. 1 that has been deformed to suit the shape of the dental arches of a particular third user.

FIGS. 4 to 6 show three ways in which the toothbrush of FIG. 1 may be deformed. The toothbrushes of the invention may be deformed at the weakened regions by manual or hand pressure applied by the user adjacent to the weakened region or by other means. The weakened regions may be formed to allow deformation perpendicular to the longitudinal axis of the handle part 12.

In FIG. 4, the neck 13 has been deformed as shown at regions 16 and 17 to improve access of the head part to the target teeth and the head 14 has been deformed upwardly at region 20. As a result, the bristles 15 of the head 14 provide a brushing surface that is slightly concave.

FIG. 5 shows the toothbrush 11 deformed according to FIG. 4 but having its head 14 deformed downwardly at region 20, rather than upwardly, thereby providing a brushing surface of bristles 15 that is slightly convex.

In FIG. 6, the toothbrush 11 has been deformed in the neck 13 at regions 16, 17 and 18 and the head 14 has been deformed at sites 19 and 20. As a result, the bristles 15 of the head 14 provide a brushing surface that is even more concave than that of the toothbrush deformed according to FIG. 4.

The particular arrangements of the neck 13 and head 14 shown in FIGS. 4 to 6 will be most effective in cleaning distal and mesial surfaces of teeth next to areas where teeth have been extracted.

It will be apparent that one advantage of the invention is that the shape of the toothbrush can be adjusted by a dentist in consultation with the user patient to suit the particular size and shape of the patient's dental arches and that the shape of the neck and head may be varied in many number of combinations. Although it is preferable for the adjustment to be done in consultation with the dentist, the present invention also allows the user to independently conduct the adjustment.

By way of dimension only, the toothbrush of the invention may come in a small (junior) size for children or a large size for adults. In the junior model, preferably the head would measure approximately 20 millimeters in length with a row of bristles missing about 8 millimeters from the distal end. In the adult model, preferably the head would measure approximately 30 millimeters in length with a row of bristles missing about 8 millimeters from the distal end and another row missing about 22 millimeters from the distal end.

For large arches, the length of the neck together with the head should preferably be about 11 centimeters. The handle should preferably be 11 or 12 centimeters in length and be at least 13 millimeters wide for adequate grip.

Various modifications may be made in details of design and construction without departing from the scope or ambit of the present invention.

For instance, the handle part of the toothbrush of the invention may have at least one weakened region so as to allow deformation thereof to suit particular forms of grip, such as the grip of infants or arthritis sufferers.

I claim:

1. A toothbrush comprising an elongated handle part having a longitudinal axis, a head part, and a neck part joining the handle part and head part, wherein said handle part, said head part, and said neck part are integrally constructed, said head part including a plurality of sides with bristles projecting from at least one of said sides thereof and having at least one region thereof weakened so as to allow deformation in the head part to suit the shape of the user's dental arches, the at least one weakened region comprising a localized narrowing in the cross-section of the head part that allows the deformation to be sharp and discrete and only at the localized narrowing and not elsewhere along the head part, the localized narrowing being integrally formed with the remainder of the head part and separating the bristles into at least two bristle carrying sections of the head part, each of the bristle carrying sections being movable independently of the other by the deformation at the localized narrowing, and wherein the at least one weakened region is so formed that it allows the deformation about an axis perpendicular to the longitudinal axis of the elongated handle part and wherein said deformation of said head part remains generally stable during use.

2. The toothbrush of claim 1 wherein the head part and the handle part each include adjacent parts connected to the neck part and wherein the neck part is of a smaller cross sectional area than the adjacent parts of the head part and the handle part.

3. The toothbrush of claim 1 wherein the neck part includes at least one region thereof weakened so as to allow deformation in the neck part to suit the shape of the user's dental arches.

4. The toothbrush of claim 1 wherein the toothbrush is made of translucent hydrocarbon resin that can be deformed at its at least one weakened region at room temperature or under hot water.

5. The toothbrush of claim 1 wherein the toothbrush is made of an opaque styrene polymer.

6. The toothbrush of claim 1 wherein the head part has two weakened regions and the neck part has three weakened regions.

7. The toothbrush of claim 1 wherein the head part has one weakened region.

8. The toothbrush of claim 1 wherein the deformation at the at least one weakened region is by manual or hand pressure applied adjacent to the at least one weakened region.

9. The toothbrush of claim 1 wherein the toothbrush is made of a transparent hydrocarbon resin that can be deformed at its at least one weakened region at room temperature or under hot water.

10. The toothbrush of claim 1 wherein the toothbrush is made of an opaque styrene copolymer.

11. A toothbrush comprising an elongated handle part having a longitudinal axis, a head part having bristles projecting therefrom, and a neck part having one end thereof joined to the handle part and another end thereof joined to the head part, wherein said head part, said neck part, and said handle part are integrally constructed, said head part also having at least one region thereof weakened so as to allow deformation in the head part to correspond to the shape of a user's dental arches, the at least one weakened region comprising a localized narrowing in the cross-section of the head part that allows the deformation to be sharp and discrete and only at the localized narrowing and not elsewhere along the head part, the localized narrowing being integrally formed with the remainder of the head part and separating the bristles into at least two bristle carrying sections of the head part, each of the bristle carrying sections being movable independently of the other by the deformation at the localized narrowing, and wherein the at least one weakened region is so formed that it allows the deformation about an axis perpendicular to the longitudinal axis of the elongated handle part and wherein said deformation of said head part remains generally stable during use.

12. A toothbrush comprising an elongated handle part having a longitudinal axis, a head part having bristles projecting therefrom, and a neck part having one end thereof joined to the handle part and another end thereof joined to the head part, wherein said head part, said neck part, and said handle part are integrally constructed, said head part also having at least one region thereof weakened so as to allow deformation in the head part to correspond to the shape of a user's dental arches, the at least one weakened region comprising a localized narrowing in the cross-section of the head part that allows the deformation to be sharp and discrete for forming a discretely angled brushing profile, the localized narrowing being integrally formed with the remainder of the head part and separating the bristles into at least two bristle carrying sections of the head part, each of the bristle carrying sections being movable independently of the other by the deformation at the localized narrowing, and wherein the at least one weakened region is so formed that it allows the deformation about an axis perpendicular to the longitudinal axis of the elongated handle part and wherein said deformation of said head part remains generally stable during use.

* * * * *